US005423655A

United States Patent [19]

Kanayama et al.

[11] Patent Number: 5,423,655

[45] Date of Patent: Jun. 13, 1995

[54] WORKING MACHINE FOR HYDRAULIC EXCAVATOR

[75] Inventors: Noboru Kanayama; Hikosaburo Hiraki; Masayuki Moriyama, all of Kanagawa, Japan

[73] Assignee: Kabushiki Kaisha Komatsu Seisakusho, Japan

[21] Appl. No.: 4,264

[22] Filed: Jan. 14, 1993

[51] Int. Cl.[6] ..... E02F 3/38

[52] U.S. Cl. ..... 414/694; 212/261; 212/300

[58] Field of Search ..... 414/694, 695.5; 212/188, 238, 261

[56] References Cited

U.S. PATENT DOCUMENTS

| | | | |
|---|---|---|---|
| 2,995,261 | 8/1961 | Soyland et al. | 414/694 |
| 3,589,539 | 6/1971 | Witwer | 414/694 |
| 4,029,225 | 6/1977 | Wirt | 414/694 |

FOREIGN PATENT DOCUMENTS

| | | | |
|---|---|---|---|
| 0399043 | 11/1990 | European Pat. Off. . | |
| 1100901 | 3/1961 | Germany | 212/261 |
| 6466319 | 3/1989 | Japan . | |
| 4155022 | 5/1992 | Japan | 414/723 |

OTHER PUBLICATIONS

Patent Abstracts of Japan vol. 016, No. 446 (M-1311) 17 Sep. 1992 & JP-A-41 55 022 (Komatsu Ltd.) 28 May 1992.

Patent Abstracts of Japan vol. 015, No. 093 (M-1089) 6 Mar. 1991 & JP-A-23 08 016 (Komatsu Ltd.).

Patent Abstracts of Japan vol. 013, No. 398 (M-866) 5 Sep. 1989 & JP-A-11 42 135 (Komatsu Ltd.).

*Primary Examiner*—Donald W. Underwood

*Attorney, Agent, or Firm*—Ronald P. Kananen

[57] ABSTRACT

A hydraulic excavator includes a boom comprising an articulated first and second boom member, an arm, a bucket, a boom cylinder for operating the boom, an arm cylinder for operating the arm; and a bucket cylinder for operating the bucket. The boom cylinder is cooperatively associated with the boom to establish a geometry wherein, during operation, the axis of the boom cylinder can never pivot rearwardly across a dead point of the boom and therefore eliminate the possibility of dead locking of the boom during operation.

2 Claims, 9 Drawing Sheets

WORKING MACHINE FOR HYDRAULIC EXCAVATOR

BACKGROUND OF THE INVENTION

1. Field of the Invention

The present invention relates to a hydraulic excavator, such as a power shovel. More specifically, the invention relates to a hydraulic excavator apparatus including a boom, an arm, a bucket and a cylinder device, for pivotally driving the boom, the arm and bucket, in which the boom is formed with articulated first and second boom members.

2. Description of Related Art

Japanese Unexamined Patent Publication (Kokai) No. 64-66319 discloses a working machine of the type which the present invention is directed to. The disclosed construction of the working machine are illustrated in FIGS. 1 to 3. As can be seen, the tip end of a boom cylinder 1 is connected to a tip end of a first boom member 2*a* of first and second boom members 2*a* and 2*b* which form a boom 2.

This conventional apparatus operates in the following manner:

(1) First, while the tip end of a bucket 3 is engaged to a tip end portion of a frame 4, the boom cylinder 1 is expanded up to a maximum length, as shown in FIG. 2. This causes the first boom to be raised by a given amount.

(2) An arm cylinder 5 is then expanded and tends to cause pivoting of the arm 6 toward a folded position about an articulation point of the second boom 2*b*. At this time, since the bucket 3 is engaged with the frame 4, the second boom 2*b* is shifted forward. Therefore, the first boom 2*a* is raised further. At a position where the first boom 2*a* has been raised sufficiently, a pin 7*c* is inserted through pin holes 7*a* and 7*b* of the first and second booms 2*a* and 2*b* for fixing them in the predetermined fixed relationship and to restrict further relative angular displacement with respect to one another.

(3) Following this, a bucket cylinder 8 is operated to release the bucket 3 from the frame 4 and to establish an operating state, in which excavation can be performed by operating respective cylinders 1, 5 and 8.

In the above-mentioned conventional arrangement, it is necessary for a longer expansion length of the boom cylinder 1 during pivoting across a rising/falling dead point (on a line extending through a pivot point of the boom cylinder 1 and a pivot point of the first boom 2*a*) than when the boom is a fully raised excavating position.

Accordingly, at the operating position illustrated in FIG. 3, the boom cylinder 1 cannot assume a fully extended condition. Therefore, it is possible to cause erroneous operation wherein the boom cylinder is further expanded to place the boom 2 and the boom cylinder 1 at the rising/falling dead point. Under these conditions, the boom 2 is disabled and unable to be raised or lowered thus inhibiting excavating operation.

As an approach to this problem, it is possible to control the raising and lowering of the boom by means of a control system by sensing the boom position with a sensor. However, in general, it is difficult or even impossible to assuredly stop the boom at exactly the same point irrespective of the expansion speed (rate) of the boom cylinder. This makes the control by means of the control system ineffective and fails to prevent the above problem. In addition, using a sensor and a control system increases the complexity of the excavator resulting in reduced reliability and increased cost.

SUMMARY OF THE INVENTION

In view of the problems set forth above, it is an object of the present invention to provide a hydraulic excavator apparatus, which permits excavating operation at a maximum stroke of a boom cylinder and prevents dead-locking of a boom at the dead point.

Another object of the present invention is to provide an apparatus which will prevent rearward pivoting of the boom across the dead point irrespective of the stroke position of the boom cylinder during excavation and thus can eliminate any restriction in boom cylinder stroke.

In order to accomplish the above-mentioned and other objects of the present invention, an apparatus or operating mechanism as it will be referred to, includes a boom and boom cylinder in which the boom cylinder is cooperatively associated with the boom to establish a geometry which is such that during operation the axis of the boom cylinder will not pivot rearwardly across a dead point of the boom and so that the possibility of dead locking of the boom during operation can be successfully eliminated.

According to one aspect of the invention, an operating mechanism or apparatus for a hydraulic excavator comprises:

a boom comprising articulated first and second boom members:

an arm;

bucket;

boom cylinder for operating the boom;

an arm cylinder for operating the arm;

a bucket cylinder for operating the bucket; and a holding means for holding the first and second boom members at a raised position; and a pivot for the boom cylinder being arranged at a longitudinally front side of a pivot point of the first frame and an upper or tip end of the boom cylinder being connected to the second boom so that the expansion stroke of the boom cylinder maximizes at the maximally raised position of the boom while positioning the axis of the boom cylinder at the front side of a dead point of the boom.

According to another aspect of the invention, an operating mechanism or apparatus for a hydraulic excavator comprises:

a boom comprising articulated first and second boom members:

an arm;

a bucket;

a boom cylinder for operating the boom;

an arm cylinder for operating the arm;

a bucket cylinder for operating the bucket; and a holding means for holding the first and second boom members at a raised position; and a pivot for the boom cylinder being arranged at a longitudinally front side of a pivot point of the first frame, and an upper tip end of the boom cylinder being pivotally connected to the second boom in common to the arm cylinder so that the expansion stroke of the boom cylinder maximizes at the maximally raised position of the boom while positioning the axis of the boom cylinder at the front side of a dead point of the boom.

According to a further aspect of the invention, an operating mechanism for an excavator comprises:

a boom which carries an arm and a bucket assembly and which includes articulately connected first and second boom members, the first boom member being pivotally connected to an excavator frame at a base end and to a base end of the second boom member at an upper or tip end, the second boom member being pivotally connected to the arm and bucket assembly at a tip end; and a boom cylinder for driving the boom and having a base end to be connected to the excavator frame and a tip end to be connected to the boom, the base end and the tip end of the boom. cylinder being arranged in such a geometrical relationship that the axis of the boom cylinder is constantly positioned at longitudinal front side of a dead point of the boom at working position irrespective of the stroke of the boom cylinder.

In an actual embodiment, the connecting point between the tip end of the boom cylinder and the boom may be placed on the second boom member. Also, the connecting point between the base end of the boom cylinder and the excavator frame may be placed in front of a connecting point between the base end of the first boom member and the excavator frame.

Furthermore, the tip end of the boom cylinder may be connected to the second boom member in common with a base of an arm cylinder of the arm and bucket assembly.

According to a still further aspect of the invention, a working machine for an operating mechanism comprises:

a boom which carries an arm and a bucket assembly and which includes articulately connected first and second boom members, the first boom members being pivotally connected to an working vehicle frame at a base end and to a base end of the second boom member at a tip end, the second boom member being pivotally connected to the arm and bucket assembly at a tip end; and a boom cylinder for driving the boom and having a base end to be connected to the working vehicle frame and a tip end to be connected to the boom, the base end and the tip end of the boom cylinder being arranged such a geometrical relationship that the axis of the boom cylinder is constantly positioned at longitudinal front side of an extension line extending through the base end of the boom cylinder and the base end of the first boom member, the boom at working position irrespective of the stroke of the boom cylinder.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

Figure 1:
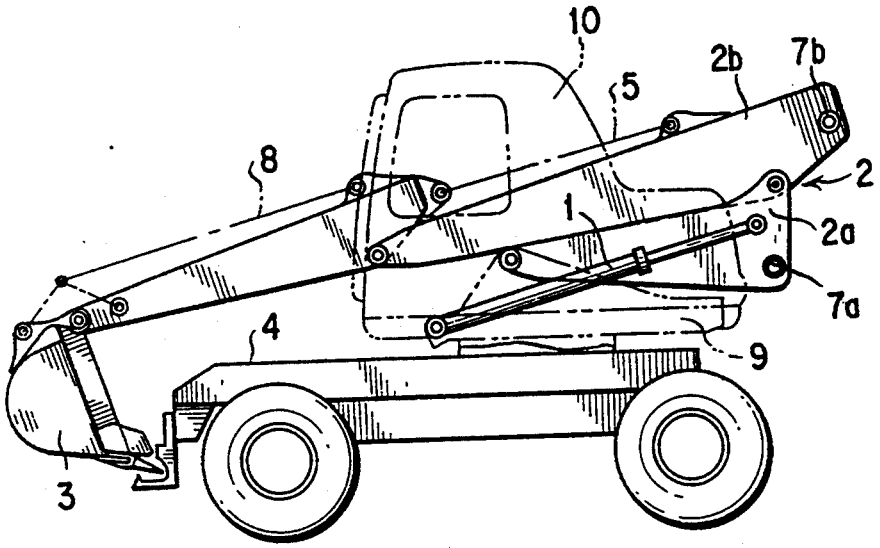
FIG. 1 PRIOR ART
FIG. 1 is a side elevation of a conventional excavator equipped with an operating mechanism of the type discussed in the opening paragraphs of this disclosure.
Figure 2:
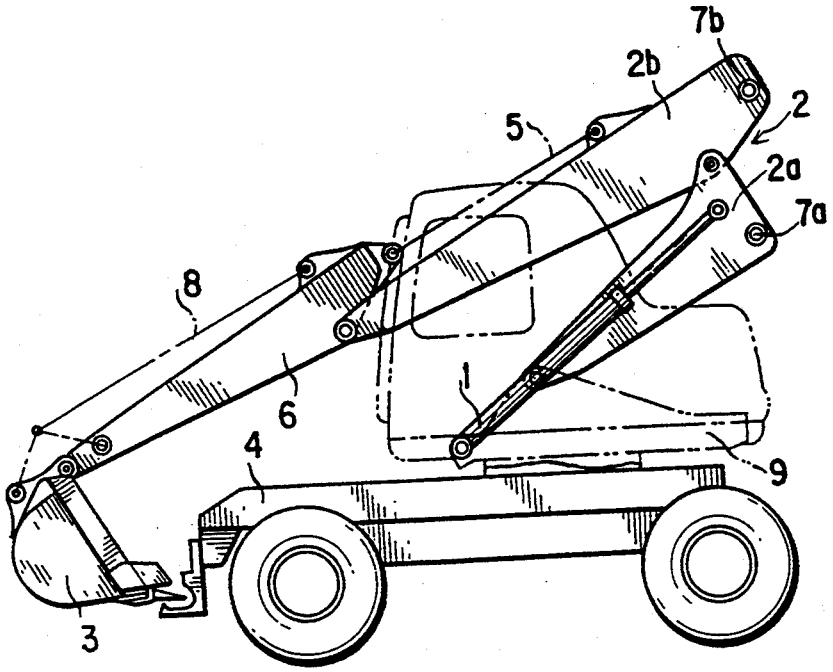
FIG. 2 PRIOR ART
FIG. 2 is a side elevation of the conventional excavator of FIG. 1, illustrating an intermediate stage in the process of changing from a rest state to an operative or working state.
Figure 3:
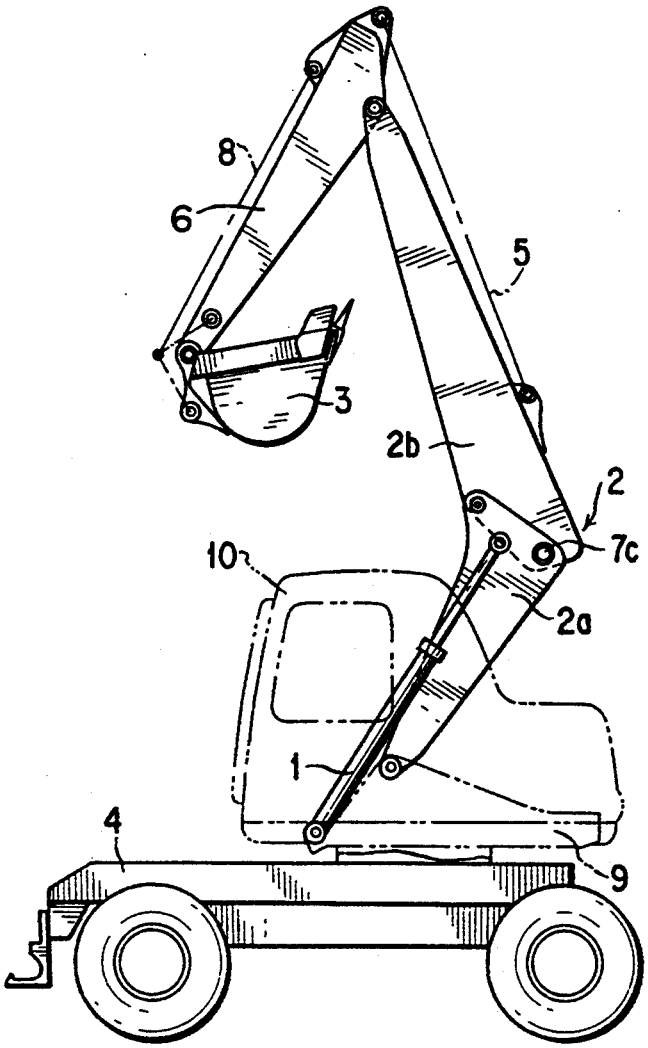
FIG. 3 PRIOR ART
FIG. 3 is a side elevation of the conventional excavator of FIG. 1, which illustrates a boom in a maximally raised state.
Figure 4:
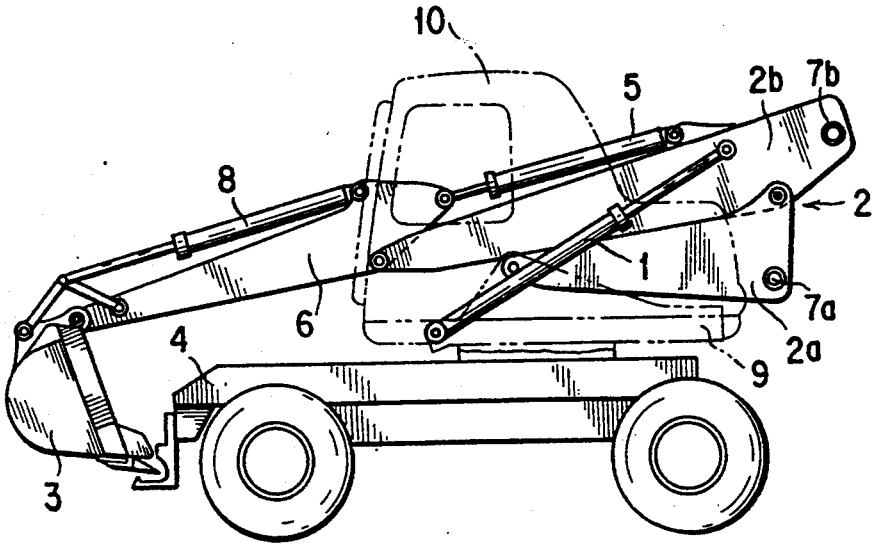
FIG. 4 is a side elevation of an excavator employing the preferred embodiment of an operating mechanism according to the present invention.

Referring now to FIGS. 4 to 9, the preferred embodiment of a hydraulic excavator employing a preferred construction of an operating mechanism according to the present invention, will be discussed. It should be noted that the same reference numerals used in FIGS. 1 to 3 illustrating the prior art are used to designate like elements.

Similarly to the prior art discussed above, a lower pivot point of a boom cylinder 1 is positioned at the longitudinally front side of a pivot point of a first boom 2*a* forming a part of a boom 2. However, the upper end of the boom cylinder 1 is pivotally connected to a second boom 2*b* instead of the first boom 2*a* as in the conventional construction. The first and second booms 2*a* and 2*b* are supported on a rotary platform 9 together with an operator's cabin 10. The rotary platform 9 is rotatably supported on a frame 4.

Figure 5:
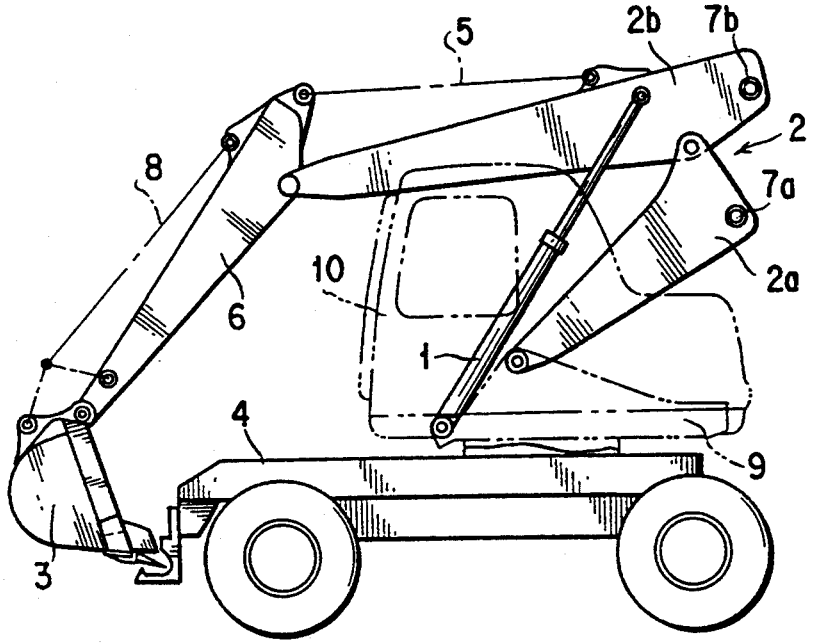
FIGS. 5 and 6 are side elevations of the excavator of FIG. 4, but showing an intermediate state which occurs during preparation of the boom.
Figure 6:
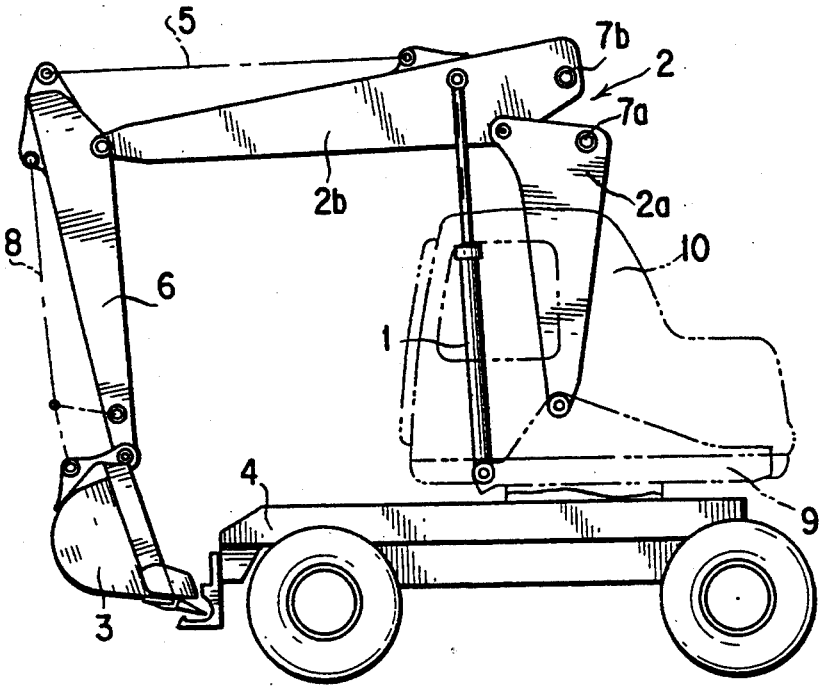
Figure 7:
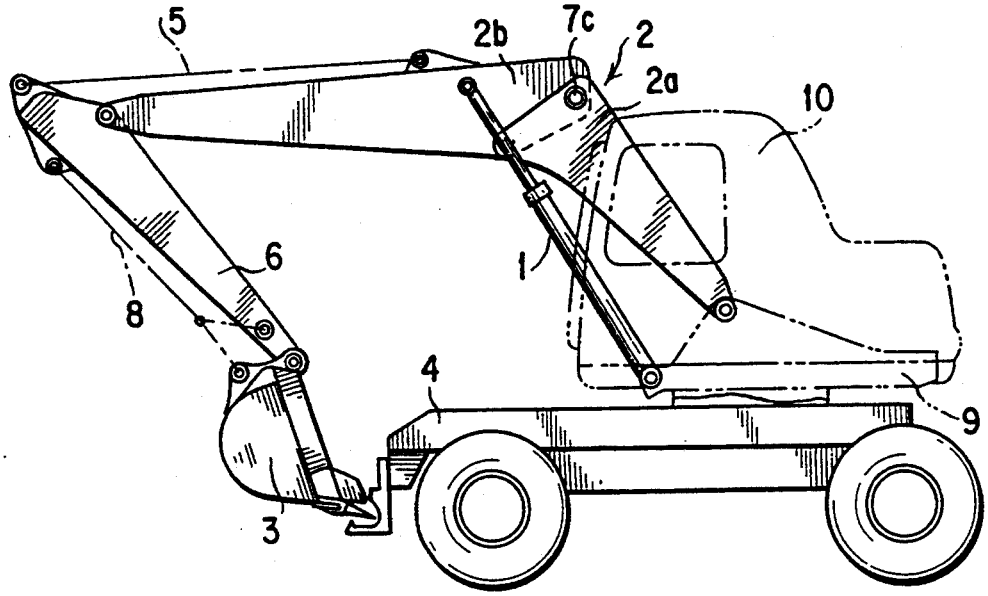
FIG. 7 is a side elevation of the excavator of FIG. 4, but showing at a state wherein the fixing of first and second boom members of the boom in fixed relationship, is completed.

FIGS. 5 to 7 show the embodiment of a hydraulic excavator in the preparatory boom cylinder 1 expansion stage. As the expansion of the boom cylinder 1 occurs with the tip end of a bucket 3 maintained in engagement with the frame 4, the first boom 2*a* is initially pivoted upwardly from the position shown in FIG. 4 to the position shown in FIG. 5, with the attendant upward lifting the second boom 2*b*. Through further expansion of the boom cylinder 1, the first boom 2*a* assumes an essentially vertical position, as shown in FIG. 6. Under these conditions, the boom cylinder 1 is still expanding and does not reach the end of the expansion stroke. From this condition, by retracting the boom cylinder 1 while expanding an arm cylinder 5, the first and second booms 2*a* and 2*b* assume the positions illustrated in FIG. 7. It should be noted that FIG. 7 shows a position where the first and second booms 2*a* and 2*b* are adjoined by a pin 7*c*.

At this condition, by releasing the bucket 3 from the frame 4 via operation of the bucket cylinder 8, the excavator is rendered ready for operation.

Figure 8:
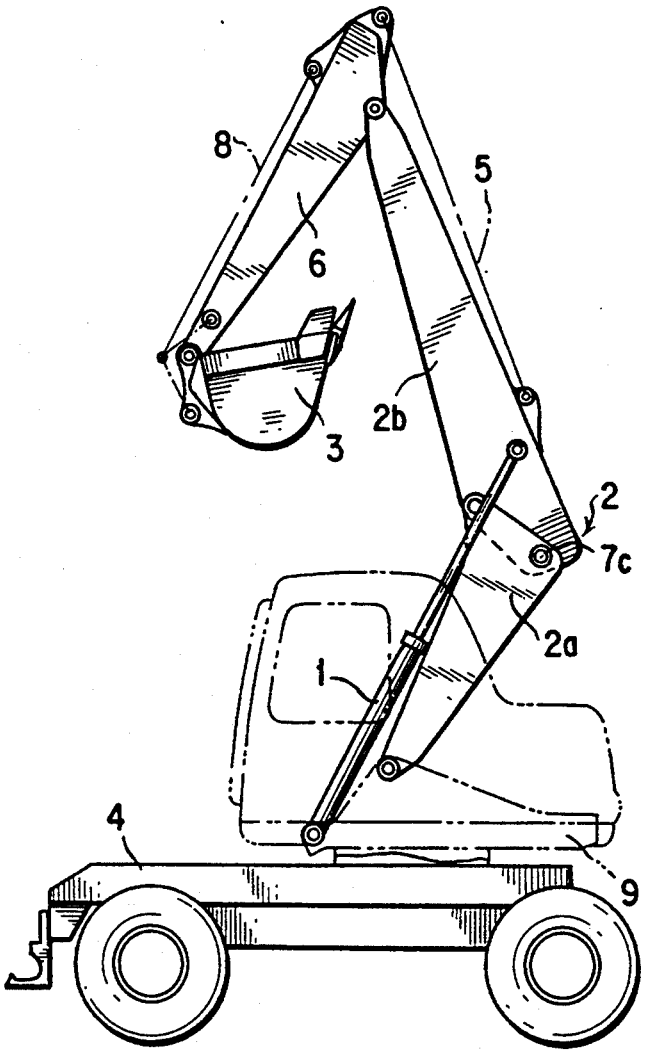
FIG. 8 is a side elevation of the excavator of FIG. 4, with the boom at a maximally raised position.

FIG. 8 shows a condition where the boom 2 is placed at a maximally raised position. In this state, the boom cylinder 1 assumes a maximally expanded condition, i.e. the expansion stroke reaches an end position. In addition, under these conditions, the pivotal center of the boom cylinder 1 is positioned at the longitudinal front side of the dead point of the beam 2.

Figure 9:
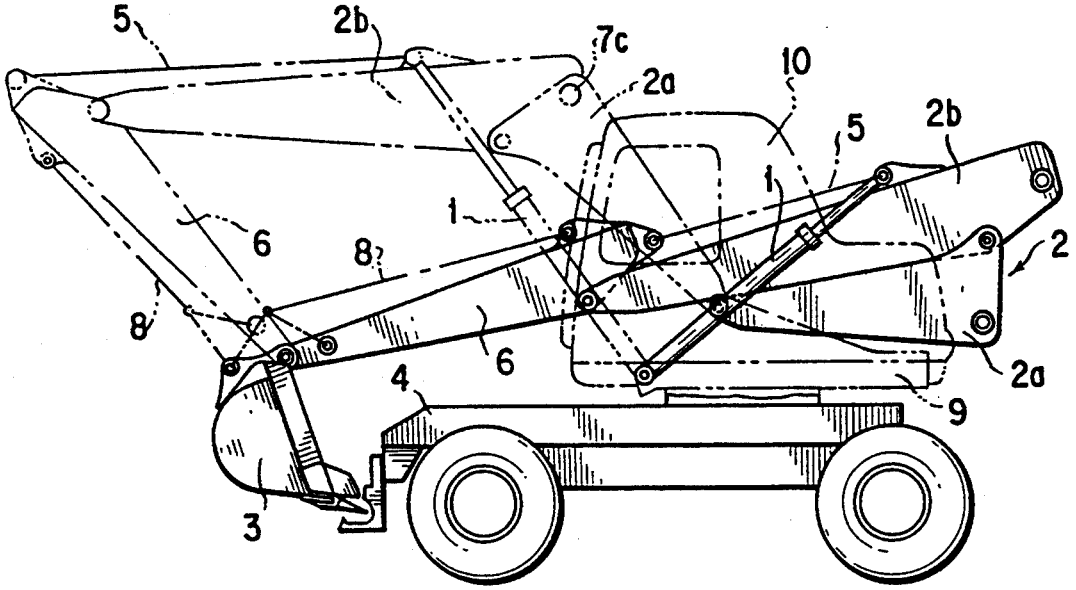
FIG. 9 is a side elevation of an excavator equipped with a second embodiment of the present invention.

FIG. 9 shows another embodiment of the operating mechansim according to the present invention. In this embodiment, the tip end of the boom cylinder 1 is commonly pivoted to the pivot point of the arm cylinder 5 on the second boom 2*b*.

With the shown construction, the boom 2 is placed at the maximally raised position by expanding the boom cylinder 1 to the maximum expansion stroke. At this position, the axis of the boom cylinder 1 will never shift rearwardly across the dead point so that dead-locking of the boom 2 can never occur during operation of the excavator.

To supplement the above disclosure, commonly assigned co-pending U.S. patent application Ser. No. 07/476,447, entitled "Working Machine for Construction Vehicles and Method of Operating the Same", is hereby incorporated by reference.

Therefore, according to the present invention, even when the boom cylinder is expanded up to the maximum stroke, the axis of the boom cylinder 1 can be maintained on the front side of the dead point in order to place the boom 2 at the maximally raised position. As a result, no restriction of the boom cylinder 1 expansion is required. Therefore, operative reliability can be improved without the need of special sensor or so forth thus assuring low cost.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above, but to include all possible variants which can be encompassed by the features set out in the appended claims and the equivalents of those features.

What is claimed is:

1. A hydraulic excavator apparatus comprising:

a boom comprising articulated first and second boom members which are connected so as to be pivotal about an articulation point;

an arm pivotally connected to said second boom member at a location distal from said articulation point;

a bucket pivotally connected to said arm;

a boom cylinder for operating said boom and which is connected between a base structure of the excavator apparatus and said second boom member;

an arm cylinder for operating said arm, said arm cylinder being pivotally connected at a first end to said second boom member and pivotally connected at a second end to said arm;

a bucket cylinder for operating said bucket, said bucket cylinder being operatively connected between the arm and said bucket;

means for releasably locking said first and second boom members in a predetermined fixed rigid relationship with respect to one another when said boom assumes a predetermined raised position; and first pivot means for pivotally supporting a lower end of said boom cylinder about a lower pivot point located at a position longitudinally forward of a pivot point on the base structure of a lower end of said first boom member;

second pivot means at an upper end of said boom cylinder for pivotally connecting the upper end of said boom cylinder to said second boom member so that the axes of said arm cylinder and said boom cylinder at said second boom member are coincident, and therefore distal from said articulation point, and for establishing a geometrical configuration whereby the expansion stroke of said boom cylinder maximizes when said boom assumes a maximally raised position and wherein a longitudinal axis of said boom cylinder is maintained on a longitudinally forward side of a line which passes through said lower pivot point and the pivot point about which the lower end of said first boom member is pivotal.

2. An excavator mechanism comprising:

a base;

a first boom member having first and second ends, the first end being pivotally mounted on said base;

a second boom member having first and second ends, said second boom member having a first end pivotally connected to the second end of said first boom member at an articulation point, said second boom member being arranged to extend in a predetermined direction over said base;

a boom cylinder having a lower end pivotally connected to said base at a location which is spaced from a location at which said first boom member is pivotally supported on said base, in said predetermined direction by a first predetermined distance, and a second end pivotally connected to said second boom member at a second predetermined distance from the articulation point toward the second end of said second boom member, said boom cylinder assuming a maximally extended state only when said boom is in a maximally raised condition;

an arm pivotally mounted on the second end of said second boom member; and an arm cylinder operatively interconnecting said arm and said second boom member, said arm cylinder being pivotally connected to said second boom arm at a location which is distal from said articulation point, and so that the pivot axes of said arm cylinder and said boom cylinder at said second boom member are one of (a) coincident with one another and (b) proximate one another.

* * * * *